United States Patent [19]

Valkama

[11] 4,225,384

[45] Sep. 30, 1980

[54] METHOD OF OPERATING A PAPER MACHINE, PARTICULARLY A PRESS SECTION THEREOF

[75] Inventor: Paavo J. Valkama, Leppäluoto, Finland

[73] Assignee: Oy Wilh. Schauman Ab, Finland

[21] Appl. No.: 878,917

[22] Filed: Feb. 17, 1978

[30] Foreign Application Priority Data

Feb. 18, 1977 [FI] Finland ..... 770540

[51] Int. Cl.[2] ..... D21F 11/02

[52] U.S. Cl. ..... 162/199; 162/206

[58] Field of Search ..... 162/111, 113, 205, 206, 162/274, 281, 305, 359, 360 R, 360 DP, 199

[56] References Cited

U.S. PATENT DOCUMENTS

| | | | |
|---|---|---|---|
| 2,653,523 | 9/1953 | Hornbostel | 162/274 |
| 3,694,311 | 9/1972 | Skeppstedt | 162/360 R X |
| 4,059,482 | 11/1977 | Kaakaanpaa et al. | 162/281 |

FOREIGN PATENT DOCUMENTS

| | | | |
|---|---|---|---|
| 1212473 | 11/1970 | United Kingdom | 162/111 |

*Primary Examiner*—Richard V. Fisher
*Attorney, Agent, or Firm*—Steinberg & Blake

[57] ABSTRACT

A method of manufacturing paper, cardboard, or another equivalent fiber web having a certain stretchability and/or a high coefficient of friction includes the steps of shortening or upsetting a paper web just prior to conveying the latter to a press section while adhering the web at the press section to a fabric in the form of a suitable felt or wire which is common to successive press nips of the press section for conveying the web to the successive press nips, these press nips including first and second press nips where the web is engaged by an additional endless fabric structure in the form of suitable felt or wire so that at least at the first and second press nips the web is sandwiched between a pair of fabrics, with this additional fabric structure being spaced from the part of the web which travels from the first to the second press nip. Subsequent to at least one of the first or second press nips the additional fabric which engages the web is dried before returning to its engagement with the web so as to remove therefrom water which has been transferred thereto from the web.

8 Claims, 3 Drawing Figures

METHOD OF OPERATING A PAPER MACHINE, PARTICULARLY A PRESS SECTION THEREOF

BACKGROUND OF THE INVENTION

The present invention relates to a method of manufacturing paper, cardboard, or another equivalent fiber web having the property of being stretchable and/or the property of having a high coefficient of friction, wherein the paper web has been shortened or upset in a known way and is then conveyed, while interposed between a pair of felts, or between a felt and a wire, or between two wires, through a first press nip and thereafter while adhering to one of the felts at all times to at least one additional press nip where the web is also interposed between a pair of felts or between two wires or between a wire and a felt.

The Finnish Pat. No. 44,334 relates to a method according to which paper having a good friction characteristic and/or a certain stretchability is manufactured. According to this known method the paper is initially subjected to deformation in such a way that the length of the paper is shortened to a given extent. Thereafter the paper web which has thus been shortened by way of a type of upsetting process is conveyed substantially unchanged between two felts or wires into the press section. Subsequent to the first press nip of the press section the web adheres to one of the felts or wires and is then conveyed thereby together with this felt or wire to a second press nip. According to this patent the second above-mentioned wire or felt also may be conducted to the second press nip, and of course there may be several such press nips.

It has been found that the achievement of a relatively high elongation capability in a paper web implies that the dry matter content thereof can be made high enough at the stage where the paper web is detached from contact with the felt or wire which conveys the same. It is therefore important that the dewatering be as high as possible at each press nip.

SUMMARY OF THE INVENTION

It is accordingly a primary object of the present invention to treat a paper web in the press section of a paper machine in such a way that the greatest possible amount of dewatering takes place so that the dry matter content of the web when it leaves the press section will be relatively high.

The method of the invention is primarily characterized in that one of the felts or wires which does not convey the web but which engages the web at a press nip has water removed therefrom before this particular felt or wire returns to this nip so as to remove from the felt or wire the water which it receives from the web, thus preventing this water from being returned into the web.

The dewatering capacity of a press nip can be influenced first by way of the construction of the press nip and also by way of the pressure applied. At the press nip it is possible to provide a so-called suction press roll or a grooved press roll, as well as a water-receiving roll in the form of a press roll having a wire in contact therewith, or any other recessed surface press roll capable of receiving water may be provided. It is also possible to utilize at a press nip simply a pair of smooth-surfaced press rolls.

The dry matter content of the web subsequent to a press nip may be raised by conveying the felt or felts to the press nips in a relatively dry condition.

Drying of the felts may be efficiently carried out at a felt or wire which does not convey the web through the press section by acting on such a felt or wire subsequent to a press nip.

It is to be understood that the felt which is detached from the web subsequent to the first press nip or subsequent to the second press nip is conveyed to a separate felt reconditioner for which purpose a felt suction box or a felt drying press is utilized. The thus treated felt is subsequently either returned to the press nip where it was detached or conveyed to the next press nip so that it is in a relatively dry condition when returning to a press nip. This procedure may be repeated as desired so that a felt which is detached from the web at a given press nip is always in a relatively dry condition when returning into engagement with the web.

It is also possible to improve the dewatering of the paper web at the press nips in the case where separate felts are conveyed to and from separate press nips by separately drying such separate felts with felt reconditioners so that such felts which travel to and from the same press nip also are in a relatively dry condition before reaching the web.

The above felt drying treatment is thus capable of being utilized at any felt to which the fiber web is not attached, and of course it may also be utilized at any felt from which the web has already been detached.

At the last press nip the paper web is conveyed while adhering only to one felt or wire. It may then be made to adhere by way of suction to the above-mentioned felt subsequent to the press nip, and it is detached therefrom by any known procedure so as to be subsequently dried. Also the web may be made to adhere to a roll at the last press nip or to a drying cylinder at the last press nip and from such a roll drying cylinder the web can be conveyed for further treatment.

In the event that the web is detached from a roll or cylinder at the last press nip by way of a doctor blade, then the detachment can be carried out entirely without any subsequent elongation of the web, and it is even possible to further shorten the paper web to a desired extent.

As has been indicated above, the dry matter content of the web has a decisive influence on the extent to which the web can be re-elongated at the point of its detachment.

BRIEF DESCRIPTION OF DRAWINGS

The invention is illustrated by way of example in the accompanying drawings which form part of the application and in which.

DESCRIPTION OF PREFERRED EMBODIMENTS

Figure 1:
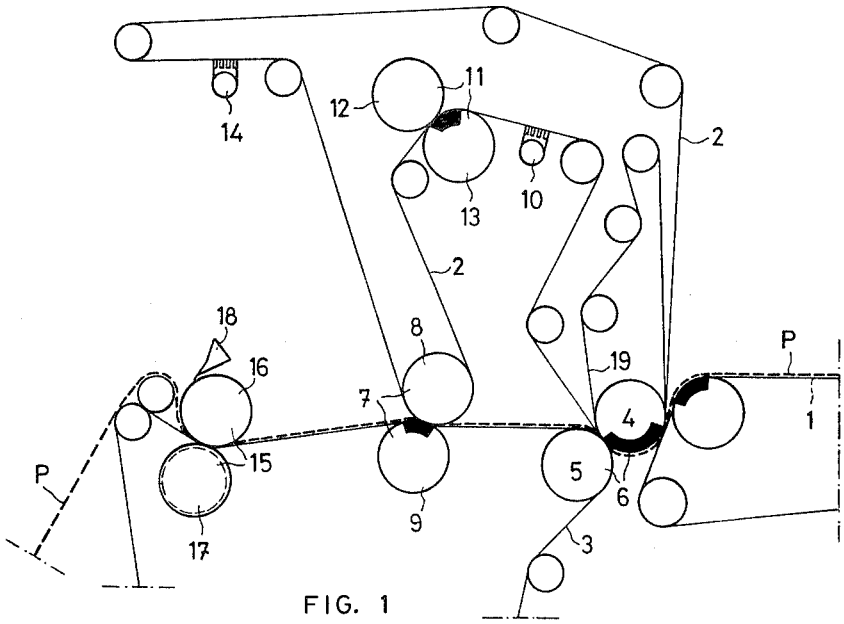
FIG. 1 is a schematic elevation illustrating that part of the paper machine where the method of the invention is carried out in the manner illustrated in FIG. 1.

Referring to FIG. 1, as is indicated schematically at the right part thereof, the paper web P has been formed on a wire 1. Subsequently the wet web is contacted by a felt 2 which has a velocity which is less than that of the wire 1. In this way the web P is subjected to a stress which upsets the web while it is attached to the felt 2 by utilizing a suction force. In this way the web P is shortened by an upsetting action to a given extent.

The paper web P is further maintained adhering to the surface of the felt 2 by way of suction at the roll 4 and it is thus conveyed in its shortened or upset condition to the first press nip 6 defined by the roll 4 and a roll 5, to which first press nip 6 a fabric means 3 also travels. This fabric means 3 is in the form of a suitable felt or wire which forms a common fabric means in that it is common to all of the nips of the press section and serves to convey the web P through successive press nips. It will thus be understood that at the first press nip 6 the web is interposed between the pair of fabric means 2 and 3 which may take the form of suitable wires or felts or any combination of a felt and wire. These endless fabric means 2 and 3 also may take the form of wire-like felts or wires provided with a felt fabric.

Within the felt 2 there is, by way of example, a separate wire 19 in the form of a so-called fabric wire. This wire 19 is interposed between the suction pick-up roll 4 and the felt 2 and prevents occurrence of undesired marking of the paper surface by the suction roll 4 while also acting as a dewatering means of the press. The wire 19 has no particular significance with respect to the method of the invention.

At the first press nip 6 the web P adheres to the common fabric means 3 to be conveyed thereby beyond the first press nip 6. Thus, while adhering to the felt 3 the web P is conveyed thereby to the second press nip 7 which is defined between the rolls 8 and 9. The fabric means 2 is also conducted to the second press nip 7 while being spaced from that part of the web which travels from the first to the second press nip. However, before the felt 2 reaches the second press nip it is dried by being subjected to the action of a felt suction means 10 or by being subjected to the action of the press rolls 12 and 13, the roll 13 being a suction roll and forming with the roll 12 a felt press 11. Of course it is possible to utilize both the suction means 10 and the felt press 11, as illustrated.

These units 10 and 11 form a felt reconditioner structure and the vacuum utilized to achieve dewatering of the felt 2 before it returns to the second press nip depends upon the speed of the machine and other service conditions. The construction of the drying press 11 is selected so that it will dewater the felt in a highly effective manner. It is also possible to improve on the drying press 11 more exact working conditions such as, for example, a higher lineal pressure, than on a press where water is also removed from the paper web itself.

At the second press nip 7 the web P is again interposed between the felts 2 and 3 and the water escapes at the second press nip from the web into both of these felts. By a proper selection of the rolls 8 and 9 the major part of the water at the second press nip can be directed to escape into the felt 2, so that part of the water escapes through the roll 8 directly at the press nip and part of the water travels with the felt 2 beyond the second press nip to be drained therefrom for example by means of the suction box 14, so that the felt 2 is dried before returning to the first press nip.

Subsequent to the second press nip 7, the paper web P while remaining attached to the common fabric means 3 travels therewith to the next press nip 15, defined by an upper smooth-surfaced roll 16 and a lower roll 17, where the web P is detached from the fabric 3 and adheres to the smooth-surfaced upper roll 16 from which it is carefully detached by being pulled therefrom or by utilizing a detaching doctor 18 having an edge onto which the web P is directed at the surface of the roll 16. Of course there may be additional intermediate nips 7 between the first press nip and the last press nip 15.

Figure 2:
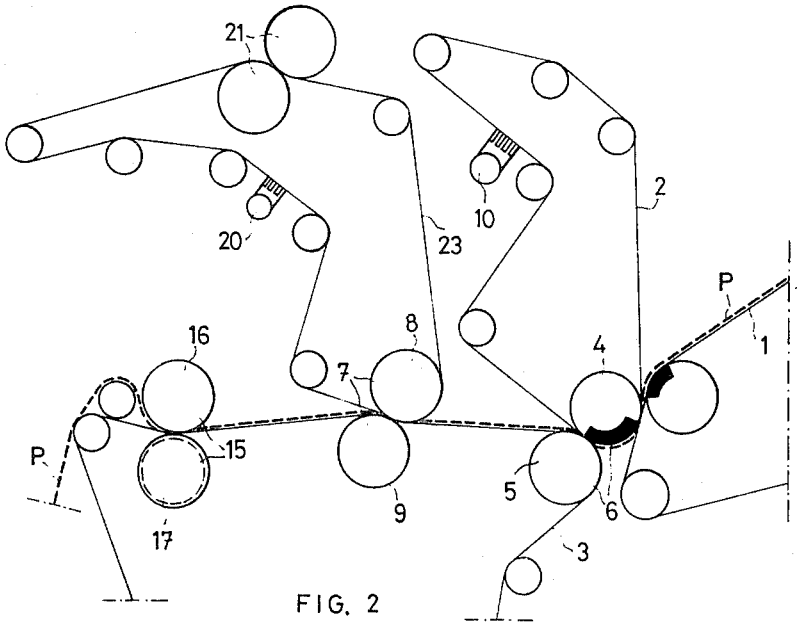
FIG. 2 shows also in a schematic elevation another embodiment of a method of the invention.

The embodiment of FIG. 2 operates according to the same principles. However, the felt at the first press nip does not travel to the second press nip. In this case an additional felt 23 forms part of the additional fabric means to be utilized at the second press nip. This additional felt 23 has its own separate felt reconditioner 20 in the form of a suitable suction box as well as a reconditioning structure which includes the drying press 21. Of course in this case also there may be several intermediate nips 7 having the structure shown in FIG. 2. The separate felt 2 for the first press nip in FIG. 2 is dried by way of the suction box 10.

Figure 3:
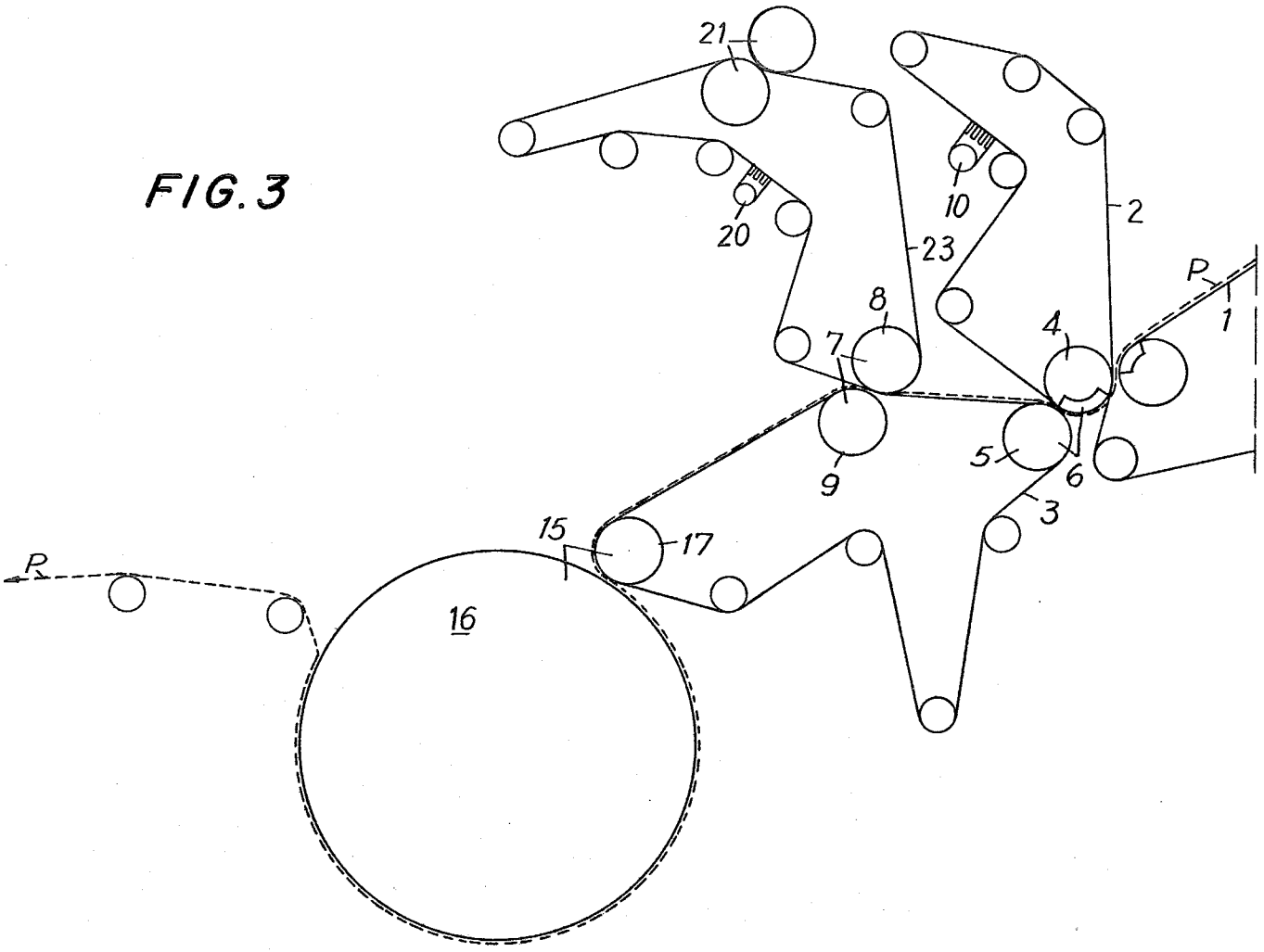
FIG. 3 is a schematic elevation illustrating still another embodiment of a method of the invention.

The embodiment of FIG. 3 also operates according to the same principles and like the embodiment of FIG. 2, an additional felt 23 forms part of the additional fabric means to be utilized at the second press nip. However, unlike the embodiments of FIGS. 1 and 2, wherein the web travels from the second press nip 7 with the common fabric means 3 to the further press nip 15 wherein it is removed from the common fabric means by a detaching doctor 18, in the FIG. 3 embodiment, the further press nip 15 comprises a drying cylinder 16 and a press roll 17. The common fabric means and web adhering thereto are conveyed subsequent to the first and second press nips to the nip 15 wherein the common fabric means and web adhering thereto are situated between the press roll 17 and drying cylinder 16.

One of the important features of the method of the invention is that the paper web which has been shortened by the upsetting action prior to the press section travels without being elongated through the successive press nips in such a way that its dry matter content will be high enough at the stage where it is detached from the roll 16 at the last press nip. Thus, the dewatering which takes place in the press section is substantially improved by drying the endless fabric means 2 or 2,23 which does not convey the web to the successive press nips but which instead only engages the web at the first and second press nips.

It is possible by way of this method to improve the stretchability or elongation characteristics of the paper both in the longitudinal machine direction as well as in the transverse cross-machine direction. The improvement of the elongation characteristics in the longitudinal direction is a direct consequence of the mechanical shortening to which the paper has been subjected prior to the press section, provided that the extent of shortening achieved at this rate can be maintained while the web travels through the press section. The increase in the transverse elongation capability of the web results from a change in the structure of the web. Furthermore, the treatment according to the method of the invention equalizes the values of the elongation capability of the paper web so that the difference between transverse elongations found by measurement at the center of the web and at the margins thereof becomes less.

In the table which follows, typical characteristics of kraft paper have been set forth by way of example, referring to conventional bag paper and, separately, to paper manufactured by the method of the invention. In other respects the conditions in which both paper types were manufactured were identical.

TABLE

| | Conventional bag paper | Paper produced as taught by invention |
|---|---|---|
| Mass per area, g/m$^2$ | 75 | 75 |
| Tension index, Nm/g, machine direction | 79 | 72 |
| cross machine | 41 | 41 |
| Ultimate elongation, %, machine dir. | 2–3 | 3–6 |
| cross machine | 4–8 | 5–10 |
| Static rupture work, J/m$^2$, machine direction | 80–11 | 100–170 |
| cross-machine | 90–130 | 110–220 |

It is seen that the elongation values are clearly higher in the case of the present invention, and as a consequence the rupture energy values are also more than 25% higher. This result is exceedingly important with a view to the durability of the bag paper which is utilized, for example.

The roughness of the paper web also increases due to the fact that the paper web is not subjected to pressure against smooth-surfaced press rolls at the first press nips, or in any step at all of the press treatment if desired. The roughness of the web, and therefore the higher coefficient of friction thereof, may be effectively influenced by way of utilizing appropriate felts.

What is claimed is:

1. In a method of manufacturing an upset fiber web such as non-crepe paper, cardboard, or the equivalent thereof, which has the property of being stretchable and/or the property of having a high coefficient of friction, the steps of shortening or upsetting the web, conveying the web after it has been shortened or upset to the first press nip of a press section and then to subsequent press nips thereof where the web is interposed between a common fabric means which is common to and travels to all of the press nips and an additional fabric means which travels at least to the first and second press nips with the web being interposed between the common fabric means and the additional fabric means at the first and second press nips while retaining the additional fabric means spaced from the web as the latter travels from the first to the second press nip, and drying the additional fabric means at least subsequent to one of said first and second press nips for removing from the additional fabric means water received thereby from said web.

2. In a method as recited in claim 1 and wherein the drying of said additional fabric means is carried out by subjecting said additional fabric means to the action of a felt drying press.

3. In a method as recited in claim 1 and wherein the drying of said additional fabric means is carried out by subjecting the latter to the action of a suction box.

4. In a method as recited in claim 1 and wherein said additional fabric means is in the form of a single endless fabric means which travels sequentially to said first and second press nips, and drying said additional fabric means between the said first and second press nips to remove therefrom water received thereby at said first press nip prior to travel of said additional fabric means to said second press nip, and then drying said additional fabric means also subsequent to said second press nip to remove from said additional fabric water received thereby at said second press nip, so that said additional fabric means is dried of the water before returning to said first press nip.

5. In a method as recited in claim 1 and wherein said additional fabric means is in the form of a pair of separate endless fabrics respectively traveling through said first and second press nips, and separately drying said separate fabrics subsequent to travel thereof through said first and second press nips so that said fabrics are dried before returning respectively to said first and second press nips.

6. In a method as recited in claim 1 and including the step of conveying said common fabric means together with a web adhering thereto subsequent to said first and second press nips to a further press nip while conveying said common fabric means and web adhering thereto between a pair of press rolls at said further press nip.

7. In a method as recited in claim 1 and including the step of conveying the said common fabric means and web adhering thereto subsequent to said first and second press nips to a further press nip while situating said common fabric means and web adhering thereto at said further press nip between a press roll and a drying cylinder.

8. In a method as recited in claim 1 and including the steps of conveying the common fabric means and web adhering thereto subsequent to said first and second press nips to a last press nip of the press section while situating said common fabric means and web adhering thereto at said last press nip between a pair of rotary press members one of which has a smooth surface directly engaging the web, and detaching the web from the latter smooth-surfaced rotary member by way of a doctor blade without creping said web.

* * * * *